US012753567B2

(12) United States Patent
Dahiwal et al.

(10) Patent No.: US 12,753,567 B2
(45) Date of Patent: Oct. 6, 2026

(54) BUCKET WITH MULTIPLE RADIUS WRAPPER

(71) Applicant: Caterpillar Inc., Peoria, IL (US)

(72) Inventors: Chetan Vilas Dahiwal, Chennai (IN); Rajkishen Paneer, Chennai (IN); Ebi Bernard, Arakkonam (IN); Koushik Kabiraj, Chennai (IN); John R. Picolet, Frankfort, KS (US); Mustafa I Alsaleh, Orland Park, IL (US); Safwat Abdelrahman Ghazawna, Champaign, IL (US)

(73) Assignee: Caterpillar Inc., Peoria, IL (US)

( * ) Notice: Subject to any disclaimer, the term of this patent is extended or adjusted under 35 U.S.C. 154(b) by 462 days.

(21) Appl. No.: 18/226,870

(22) Filed: Jul. 27, 2023

(65) Prior Publication Data

US 2025/0034832 A1 Jan. 30, 2025

(51) Int. Cl.
*E02F 3/40* (2006.01)
*E02F 9/28* (2006.01)

(52) U.S. Cl.
CPC ..... *E02F 3/40* (2013.01); *E02F 9/2883* (2013.01)

(58) Field of Classification Search
CPC ... E02F 3/141; E02F 3/40; E02F 3/401; E02F 9/28; E02F 9/2883
USPC ..... 37/411, 444, 903
See application file for complete search history.

(56) References Cited

U.S. PATENT DOCUMENTS

| | | | | |
|---|---|---|---|---|
| 9,758,947 | B2 | 9/2017 | Serrurier et al. | |
| 10,689,201 | B1 * | 6/2020 | Braime | B65G 17/126 |
| 11,391,010 | B2 | 7/2022 | Coulson | |
| 2017/0350091 | A1 * | 12/2017 | Worth | E02F 3/40 |
| 2021/0388574 | A1 | 12/2021 | Hampson et al. | |

FOREIGN PATENT DOCUMENTS

| | | | | |
|---|---|---|---|---|
| AU | 2004237824 | A1 * | 6/2005 | |
| CN | 211472635 | U | 9/2020 | |
| CN | 212534251 | U | 2/2021 | |
| CN | 114108724 | A | 3/2022 | |
| EP | 3470585 | | 4/2019 | |
| EP | 3470585 | A1 * | 11/2019 | E02F 9/2883 |
| KR | 20150064215 | A * | 6/2015 | E02F 3/40 |
| WO | 2021248183 | A1 | 12/2021 | |

OTHER PUBLICATIONS

AU 2004237824 A1 (Year: 2005).*
KR 20150064215 A (Year: 2015).*
AU-2004237824-A1 (Year: 2004).*
KR-20159964215 (Year: 2015).*
EP-3470585-A1 (Year: 2019).*
Written Opinion and International Search Report for Int'l. Patent Appln. No. PCT/US2024/033937, mailed Oct. 1, 2024 (12 pgs).

* cited by examiner

*Primary Examiner* — Christopher J Sebesta
*Assistant Examiner* — Evan A Bregel

(57) ABSTRACT

A bucket for a work machine is disclosed. The bucket has a base plate at a top end of the bucket, a lip plate at a bottom end, and a pair of side plates that extend down from the base plate to the bottom end. A wrapper has a first curved portion, having a first radius of curvature, that extends to a first flat portion. The first flat portion extends to a second curved portion having a second radius of curvature. The first flat portion extends between the first curved portion and the second curved portion.

16 Claims, 7 Drawing Sheets

BUCKET WITH MULTIPLE RADIUS WRAPPER

TECHNICAL FIELD

The present disclosure generally relates to earthmoving buckets, and more particularly, to a bucket for a work machine for use with construction and earthen material machinery.

BACKGROUND

In construction, heavy machinery such as excavators and mining shovels are typically utilized to remove earthen materials. In general, these construction machines have a traversing body and a revolving body that is rotatable relative to the traversing body in order to rotate a work tool attached to the rotating body. The work tool is often attached to the rotating body by a linkage that may include a boom and an arm. Many of these work tools are buckets that are subjected to severe wear, particularly when used with abrasive materials or when the bucket tends to excessively rub or impinge the excavation materials. The bottom corners and surfaced of the bucket are especially prone to wear as they are often the point of contact with the abrasive materials and excavational materials. The constant contact of these bottom corners and surfaces can lead to uneven wear of the bucket, causing the bucket to have to be rebuilt even though the remaining portions of the bucket are not worn.

U.S. Pat. No. 11,391,010 describes a backhoe excavator bucket that has a floor that extends from a front cutting edge to a top assembly that connects the bucket to an earth moving or materials handling machine. The backhoe excavator bucket also has two opposed side plates and a plurality of wear components that extend along an edge of the floor and an edge of the side plate on both sides of the bucket.

While effective, there remains a need for improved bucket designs for work machines used in high wear applications, such as the construction and mining industries.

SUMMARY

In accordance with one aspect of the present disclosure, a bucket for a work machine is disclosed. The bucket has a base plate at a top end of the bucket and a lip plate at a bottom end. First and second side plates extend downwards from the base plate to the bottom end. A wrapper is attached to lip plate and the base plate, and has a first curved portion, having a first radius of curvature, that extends from the bottom end of the bucket to a first flat portion. The first flat portion extends to a second curved portion that has a second radius of curvature, with the second curved portion extending to the base plate. The first flat portion which extends between the first curved portion and the second curved portion is substantially planar.

In accordance with another aspect of the present disclosure, a work machine is disclosed. The work machine may include a base that is configured to be supported on a ground surface, a revolving frame that is rotatable about the base, and an arm that can support a work tool, such as a bucket. The bucket is supported at a base plate and may be pivotally connected to the arm. The bucket has a first side plate and a second side plate that extend downwards from the base plate to a bottom end of the bucket. The bottom end of the bucket has a lip plate. A wrapper has a first curved portion at the bottom end of the bucket which extends to a first flat portion of the wrapper. The first flat portion extends to a second curved portion of the wrapper, which itself extends to the base plate. First curved portion has a first radius of curvature and the second curved portion has a second radius of curvature that is larger that the first radius of curvature.

In accordance with a further aspect of the present disclosure, a method of making a bucket is disclosed. The method includes a base plate that defines an inner cavity ceiling of the bucket is first provided, along with a lip plate that defines a lip plate at a bottom end of the bucket. Then, a wrapper is extended from the lip plate to the base plate of the bucket. The wrapper has a first curved portion that has a first radius of curvature that extends from the bottom end of the bucket to a first flat portion of the wrapper, the first flat portion extends to a second curved portion of the wrapper, which has a second radius of curvature. The second curved portion extends to the base plate. Then, a first curved corner and a second curved corner are attached. Finally, a first side plate and a second side plate are extended from the base plate to the curved corners.

These and other aspects and features of the present disclosure will be more readily understood when read in conjunction with the accompanying drawings.

DETAILED DESCRIPTION

Figure 1:
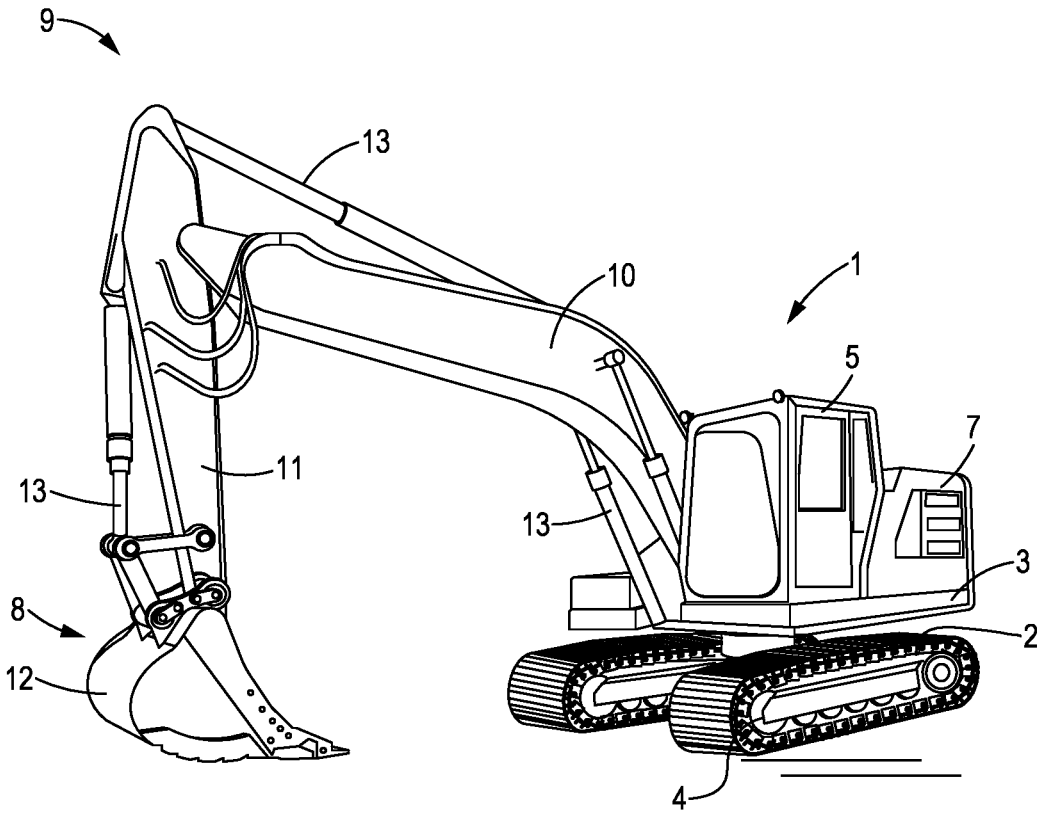
FIG. 1 is a diagrammatic illustration of a work machine having a bucket.

Referring to FIG. 1, a work machine 1 is shown. The work machine 1 may embody a fixed or mobile machine that performs some type of operation associated with an industry such as construction, mining, farming, transportation, or other industries known to utilize heavy equipment. For example, the work machine 1 may be an earth moving machine such as an excavator, as shown, or mining shovel, backhoe, a loader, a truck, or any other earth moving machine.

The work machine 1, as shown as an excavator in the FIG. 1 exemplary embodiment, includes a base body 2 that is supported on a ground surface. The base body 2 supports a revolving frame 3 that is slewably attached to the base body 2, and the revolving frame 3 being up to 360 degrees rotatable relative to an axis of base body 2. The base body 2 is supported on a crawler-type (or wheeled-type discussed below) lower traveling body 4, but in another exemplary embodiment, the traveling body 4 may support wheels or other movement supporting means. An operator cab 5 containing the operator controls (not shown) necessary to operate the work machine 1 is mounted on the revolving frame 3. The operator controls (not shown) may contain any screens, gauges, lights, etc. for displaying operational information of the work machine, alarms, or any statuses of the work machine. The operator controls further may contain any of the controls for controlling the implements (discussed below), frame, linkages, or any of the movements of any part of the work machine 1. The operator controls, in one exemplary embodiment, are designed to receive an input from an operator of the work machine, either located in the operator cab 5 or an operator remotely operating the work machine 1, and send movement signals, some of which are discussed below, to a controller (not shown) of the work machine 1. In another exemplary embodiment, the work machine 1 is mechanically operated, such as through a direct mechanical, or electrical, connection from the operator controls to a hydraulic system.

The revolving frame 3 has a motor 7, and in the present exemplary embodiment, an internal combustion engine such as a diesel engine is used as the engine as a power generation device, but in another exemplary embodiment, another power generation device is used such as an electric motor, hybrid motor, or the like. The motor 7 is used to power the movements of the work machine 1, such as powering the traveling body 4 to move the work machine 1 on a ground surface, the rotating of the revolving frame 3, and any movements of any implements or linkage systems of the work machine 1.

A work tool 8, in the FIG. 1 exemplary embodiment, is attached to the revolving frame 3. Specifically, the work tool 8 is raisably and lowerably attached to the revolving frame 3 by a linkage system 9. The linkage system 9 includes a boom 10, an arm 11 that is pivotably attached to the distal end of the boom 10, and a bucket 12 that is pivotably attached to the distal end of the arm 11. The bucket 12 is able to dig or hold a predetermined held object, such as earthen material. The position of the boom 10, arm 11, and bucket 12 is controlled by the motor 7 and a hydraulic system 13, which includes the motor 7 and any hydraulic actuators, cylinders, and additional hydraulic motors (not shown) attached to the base frame 2, revolving frame 3, boom 10, arm 11, and bucket 12. More specifically, the motor and hydraulic system 13 are able to raise and lower the boom 10 that is pivotably attached to the revolving frame 3, raise and lower the arm 11 that is pivotably attached to the boom 10, and raise and lower the bucket 12 that is pivotably attached to the arm 11. As discussed above, the hydraulic system 13 may be directly controlled from the operator controls, or may receive movement signals from the controller. In one exemplary embodiment, the operator controls receive the input from the operator, the operator controls sending the received input to the controller, and the controller sending movement signals to the hydraulic system 13.

Referring to FIGS. 2-6, the bucket 12 is shown, according to an exemplary embodiment. The bucket 12 includes a first cavity wall 13 and a second cavity wall 14. The first and second cavity walls 13, 14 define an inlet 15, and specifically define the width of the inlet 15, through which the bucket 12 is filled with earthen materials during a digging operation. The interior of the bucket 12 defines a cavity 44, which is the interior space of the bucket 12 that is capable of being filled during the digging operation.

A hinge plate assembly 16 extends along a top end 17 of the bucket 12 and has a pair of hinge plates 18 that extend generally parallel to a first side plate 19 and a second side plate 20 of the bucket 12. Each hinge plate has a front aperture 21 and a rear aperture 22, with the front apertures 21 of each of the hinge plates 18 axially aligned and configured to receive and support a stick pin (not shown) that passes through arm 11 of the linkage assembly 9 of the work machine 1. The rear apertures 22 of the hinge plates 22 are axially aligned and are configured to receive and support a tool actuator pin (not shown) that passes through the tool actuator of the work machine 1. In another exemplary embodiment, a different number of apertures or attachment means may be used to attach the bucket 12 to the arm 11, and manipulate the bucket 12 around the arm 11. For example, the hinge plates 18 may include one or more openings or recesses to reduce the weight of the hinge plate, or may be relatively elongated and include tapered sections that extends to provide additional support of the bucket 12.

The hinge plate assembly 16 also has a base plate 23 that extends between the first cavity wall 13 and the second cavity wall 14. The base plate 23 forms the base of support for the bucket 12, with the hinge plates 18 being attached to the base plate 23. Hinge plate assembly 16 also includes an upper wrapper plate 24 that extends laterally between first and second cavity walls 13, 14, and is attached to a base plate front end 25 at a generally linear first section 26 and attached to a base plate rear end 26 at a curved or arcuate second section 27. In one exemplary embodiment, the upper wrapper plate 24 may be a one-piece continuous joint-free member that extends between the sides of the bucket 12, in another exemplary embodiment, the upper wrapper plate 23 may be a one-piece member that is formed of a plurality of components that are joined together, such as welding. The bottom surface of the base plate 45 defines the inner cavity ceiling of the cavity 44, or in other words, defines the top surface of the cavity 44 of the bucket 12.

Figure 3:
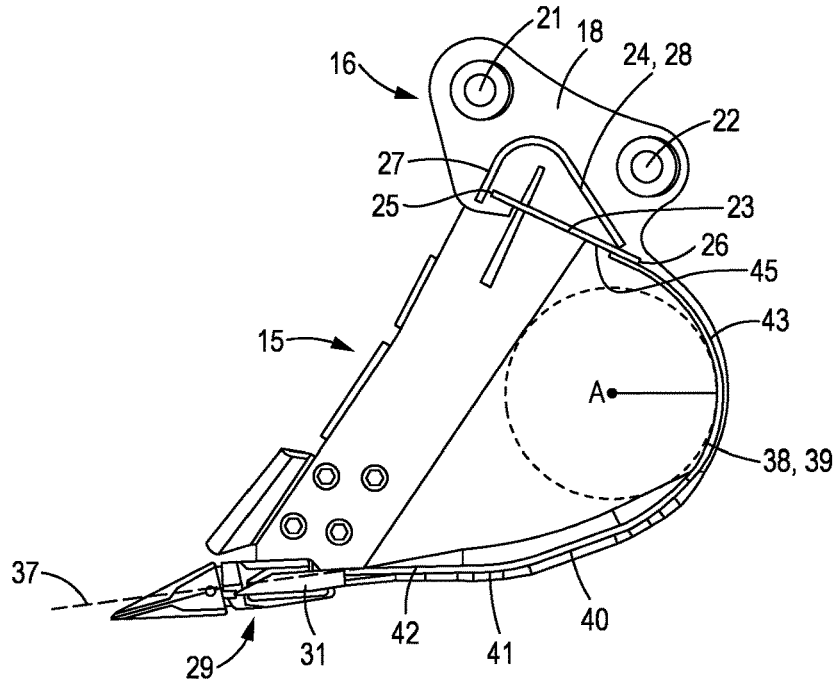
FIG. 3 is a cross-section side view of the bucket of FIG. 2, in accordance with the present disclosure.
Figure 7:
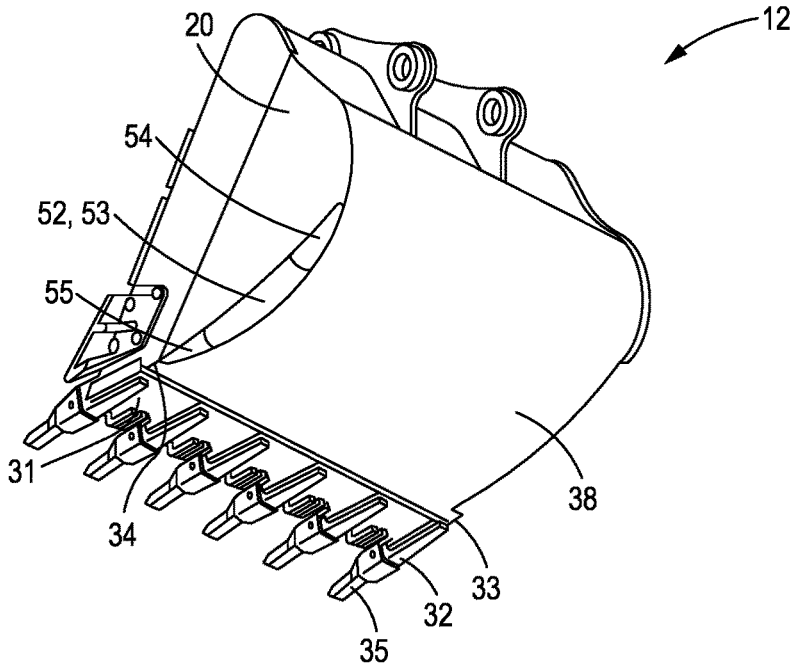
FIG. 7 is a bottom perspective view of the bucket of FIG. 2 with the wear strips, wear brackets, and the side wear plates removed, in accordance with the present disclosure.

The first side plate 19 and second side plate 20 extend downwardly from the base plate 23 to a bottom end 29 of the bucket 12 that comprises a cutting edge 30 of the bucket 12. The cutting edge 30 of the bucket 12 includes a lip plate 31 coupled to a bottom surface 33, 34 (FIG. 7) of each of the first and second side cavity walls 13, 14. The lip plate 31 may comprise a plurality of adaptors 32 (FIG. 8), where each adaptor of the plurality of adaptors is configured to hold a pierce digging tooth 35. In one exemplary embodiment, the number of adaptors comprising the plurality of adaptors is between 5-10, but any number of adaptors suitable to conduct a digging operation may be used. The adapters 32 may extend outwardly in a direction away from the inlet 15. As shown in FIG. 3, the lip plate 31 has a top surface defining a lip plane 37. In one exemplary embodiment, the lip plane is angled downwards between 1 and 5 degrees, relative to the to the wrapper 38, and specifically is angled downwards relative to a second flat portion of the wrapper (discussed below).

A wrapper 38 forms the top, back, and bottom walls of the bucket 12. The wrapper 38 is a formed plate, comprised of one or more pieced, that extends from the lip plate 31, to the base plate 23 of the bucket 12. Specifically, a second flat portion 42 of the wrapper 38 extends from the lip plate 31 to a first curved portion 41, with the first curved portion 39 extending from the second flat portion 41 to a first flat portion 40 of the wrapper 38. The first flat portion 40 of the wrapper 38 extends to a second curved portion 39 of the wrapper 38. Thus, second flat portion 42 of the wrapper 38 is connected to the cutting edge 30, or more specifically, in one exemplary embodiment, is connected to the lip plate 31 of the cutting edge 30. The wrapper, in one exemplary embodiment is a unitary construction made of one piece, but in another exemplary embodiment, the wrapper may be made of two or more pieces that are connected together to form the wrapper.

Figure 4:
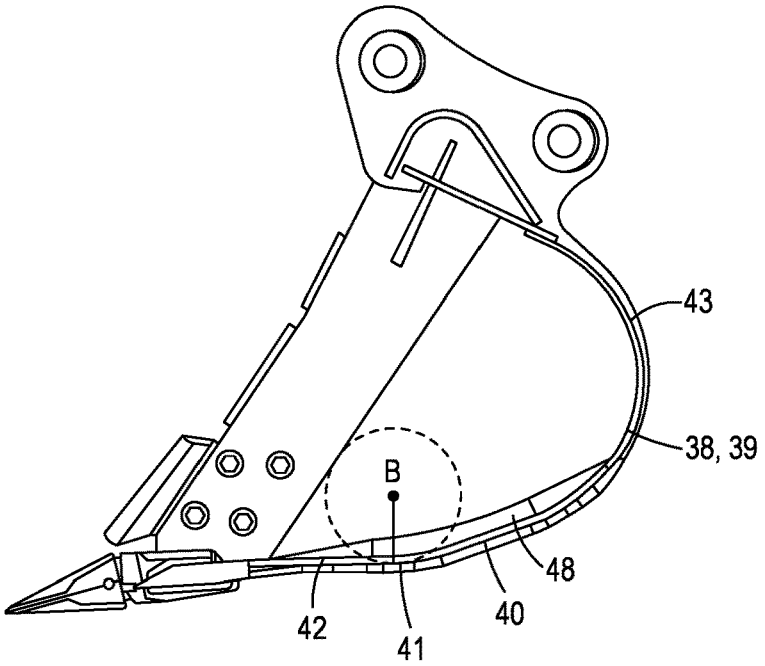
FIG. 4 is a cross-section side view of the bucket of FIG. 2, in accordance with the present disclosure.

In one exemplary embodiment, the first curved portion 41 has a first radius of curvature A, shown in FIG. 4, and the second curved portion 39 has a second radius of curvature B, as shown in FIG. 3. The radius of curvature being the radius of an approximating circle formed by the arc of the first and second curved portions of the wrapper 38, as shown by their cross-sectional views in FIGS. 3-4. In this exemplary embodiment, the first radius of curvature A is smaller than the second radius of curvature B.

Further, the first and second flat portions 40, 42, respectively, are shown to be substantially planar, or flat, in their cross-sectional view in FIGS. 3-4, with the first flat portion 30 connecting the first curved portion 41 of the wrapper 38 to the second curved portion 39 of the wrapper 38.

Figure 5:
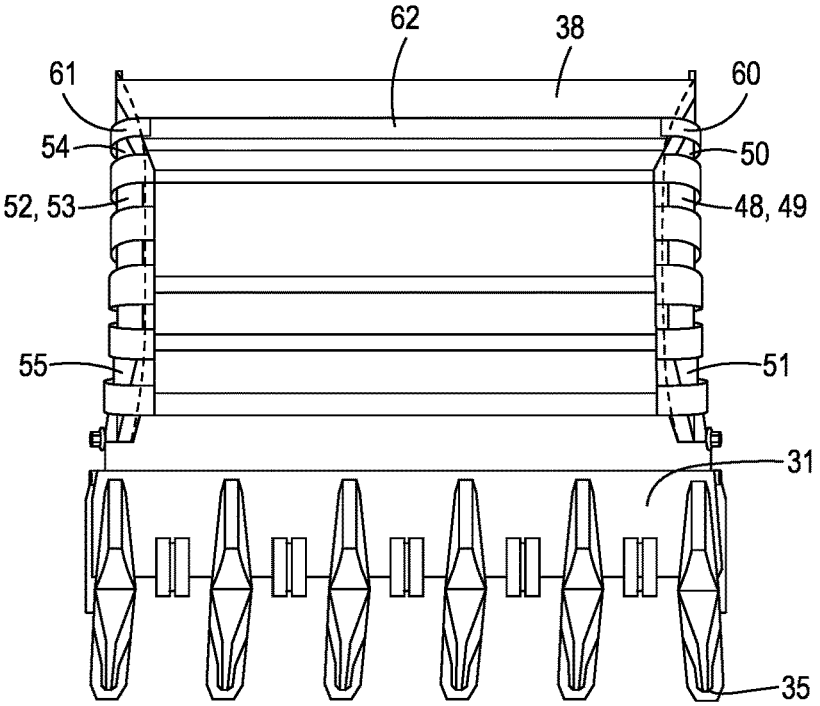
FIG. 5 is a bottom view of the bucket of FIG. 2, in accordance with the present disclosure.

As best shown in FIG. 5, the wrapper 38 has a concave shape, in that its middle portion is thinner than the top and bottom of the wrapper 38, or in other words, its middle portion is not as wide as where the end of the wrapper 38 connects to the base plate 23 nor the end of the wrapper 38 that connects to the lip plate 31. This concave shape is to allow for the connection of the first curved corner 48 and the second curved corner 52 of the bucket 12. The first curved corner 48 and the second curved corner 52 are curved corners of the bucket that define the curved interior corners of the cavity 44, as well as define the curved corner on the bottom end 29 of the exterior of the bucket.

Figure 9:
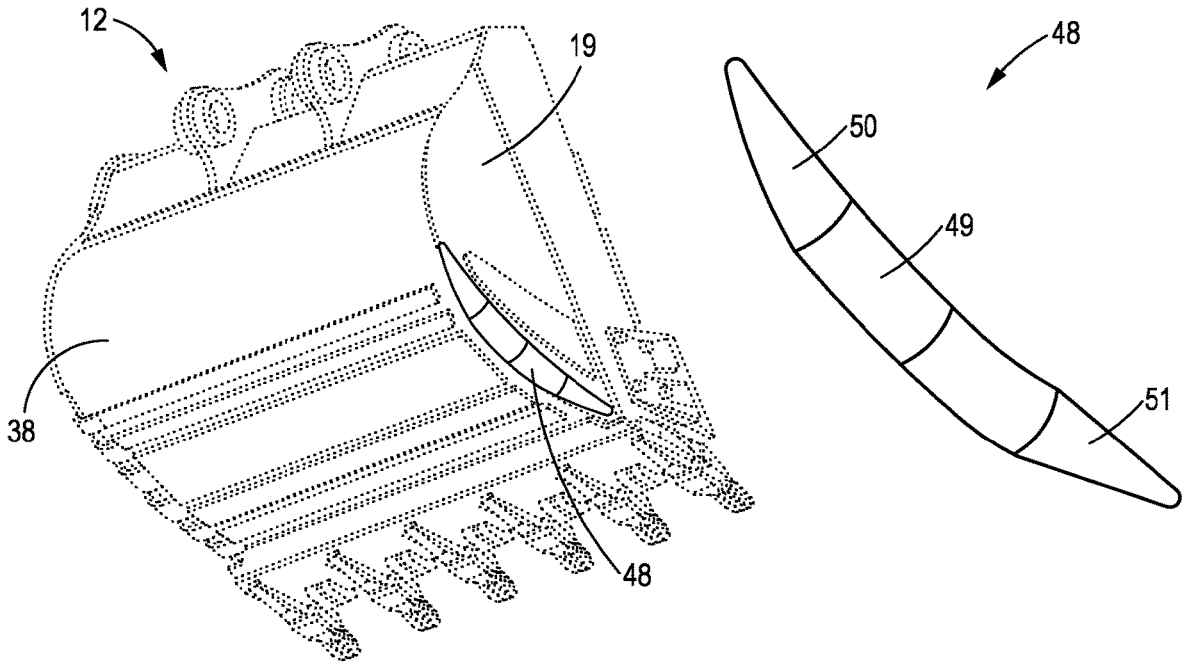
FIG. 9 is a partial view of the first curved corner of the bucket of FIG. 2, in accordance with the present disclosure.

The first curved corner 48, as best shown in FIG. 9, extends from a first side 87 of the bucket 12 to the first side plate 19 and defines the first corner of the bucket. In one exemplary embodiment, the first curved corner 48 is comprised of the three portions, a constant radius of curvature portion 49, a first decreasing radius of curvature portion 51, and a second decreasing curvature of radius portion 50. As shown, the constant radius of curvature portion 51 has a constant radius of curvature, and the decreasing radius of curvature portions 51, 50 have a decreasing radius of curvature.

Figure 2:
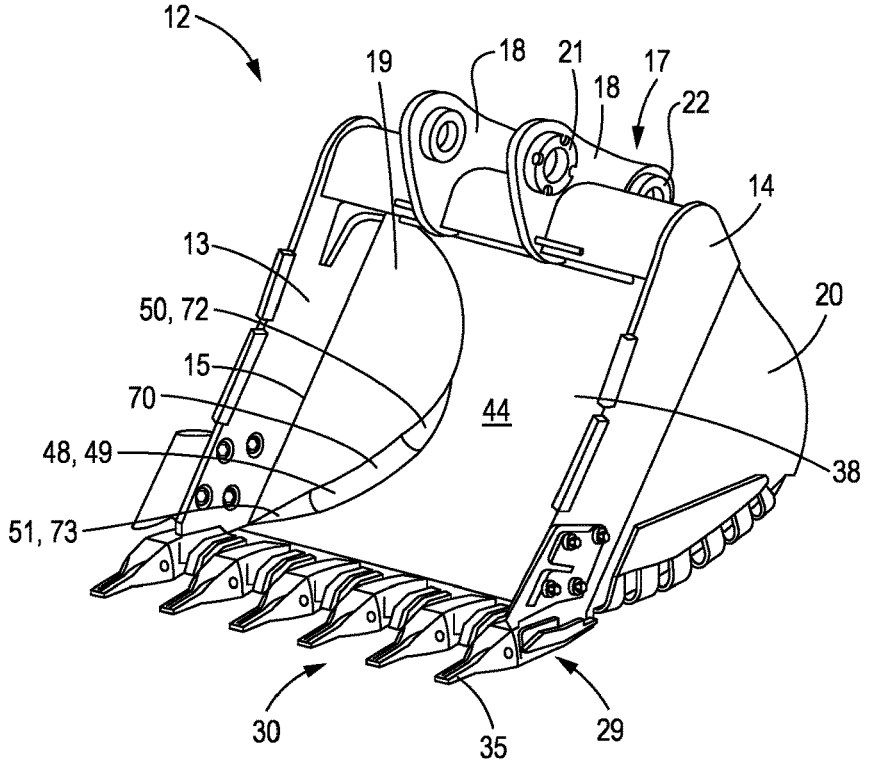
FIG. 2 is a perspective view of an exemplary bucket, in accordance with the present disclosure.

As shown in FIG. 2, the constant radius of curvature portion 49 defines a first corner arc surface 70 in the cavity 44 of the bucket. In one exemplary embodiment, the constant radius curvature portion 49 is attach to the wrapper, and extending along the wrapper from the second curved portion 39 through the second flat portion 42. In another exemplary embodiment, the constant radius of curvature portion 49 extends from the first curved portion 41 of the wrapper 38 through the first flat portion 40 of the wrapper, the first decreasing radius of curvature portion 51 extending from the constant radius of curvature portion 49 towards the lip plate, and the second decreasing radius of curvature portion 50 extending from the constant radius of curvature portion 49 towards the base plate 23.

Similarly to the first curved corner 48, FIG. 5 shows the second curved corner 52. The second curved corner 52 extends from a second side 88 of the bucket 12 to the second side plate 20 and defines the second corner of the bucket. In one exemplary embodiment, the second curved corner 52 is comprised of the three portions, a constant radius of curvature portion 53, a decreasing radius of curvature portion 55, and a second decreasing curvature of radius portion 54. As shown, the constant radius of curvature portion 53 has a constant radius of curvature, and the decreasing radius of curvature portions 54, 55 have a decreasing radius of curvature.

The second curved corner 52 has the constant radius of curvature portion 53 which defines a second corner arc surface (not shown) in the cavity 44 of the bucket 12. In one exemplary embodiment, the constant radius curvature portion 53 is attach to the wrapper, and extending along the wrapper from the second curved portion 39 through the second flat portion 42. In another exemplary embodiment, the constant radius of curvature portion 53 extends from the first curved portion 41 of the wrapper 38 through the first flat portion 40 of the wrapper, the first decreasing radius of curvature portion 55 extending from the constant radius of curvature portion 49 towards the lip plate 31, and the second decreasing radius of curvature portion 54 extending from the constant radius of curvature portion 53 towards the base plate 23.

Figure 8:
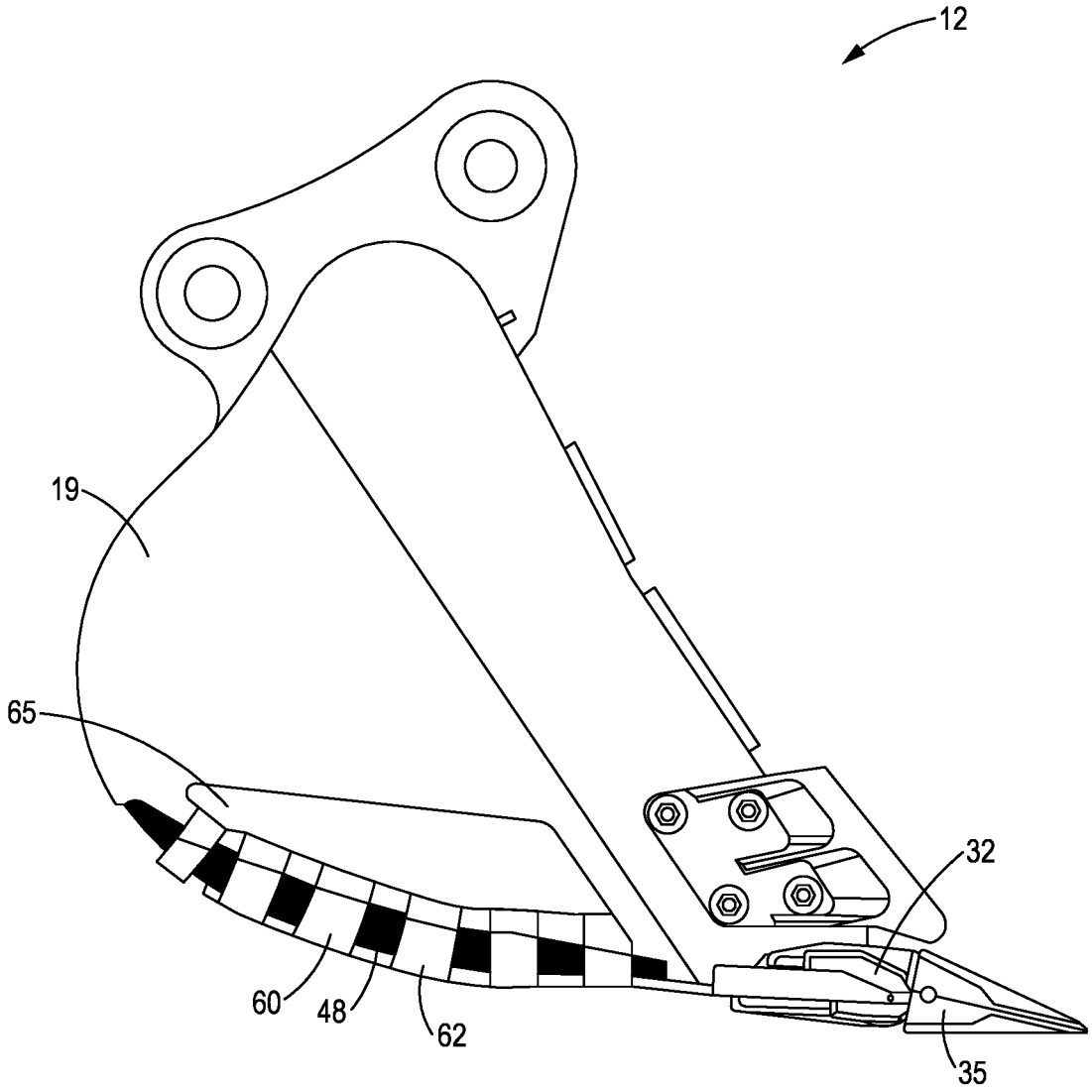
FIG. 8 is a side view of the bucket of FIG. 2, in accordance with the present disclosure.

Turning to FIG. 8, the bucket 12 may further comprise wear plates on either side, or both sides, of the bucket 12 to support wear plates, strips, and/or brackets. For example, as shown in FIG. 8 on the first side plate is an exemplary embodiment of the bucket 12 having wear strips, as opposed to the FIG. 7 view of the bucket that has the wear strips removed. In the FIG. 8 exemplary embodiment, a wear plate 65 is attached to the first plate 19 by welding or any other attachment means. The wear plates, strips, and/or brackets may be formed of any material, including any metals or allows, that are harder than the materials used to form the wrapper 38.

Figure 6:
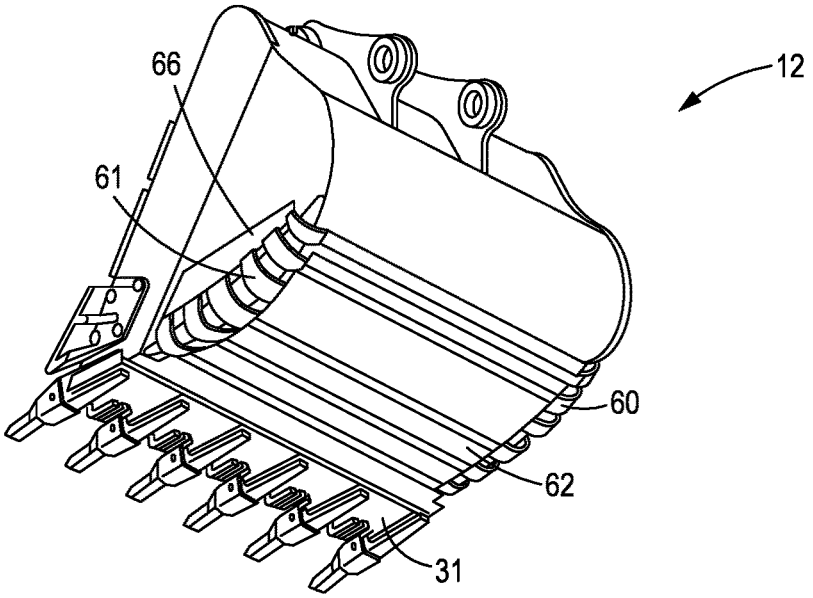
FIG. 6 is a bottom perspective view of the bucket of FIG. 2, in accordance with the present disclosure.
Figure 10:
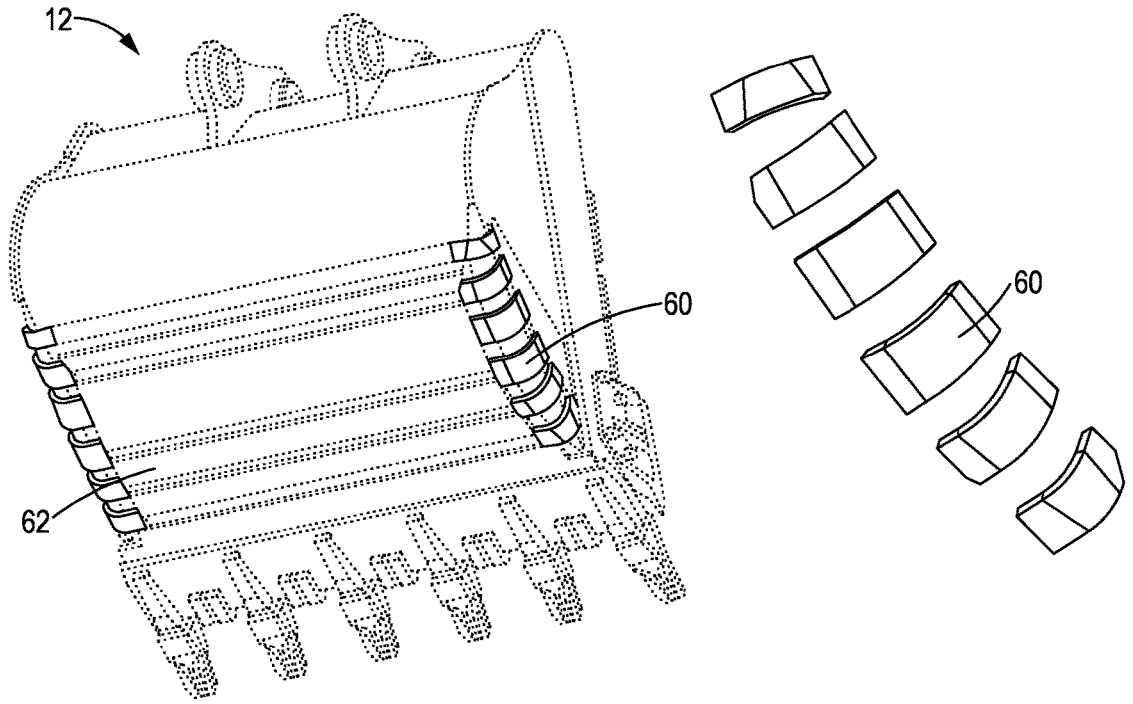
FIG. 10 is a partial view of the curved brackets of the bucket of FIG. 2, in accordance with the present disclosure.

Extending from, and attached to, the wear plate 65 are curved brackets 60 having a variety of radiuses of curvature. As shown in FIG. 10, a plurality of brackets pieces 60 are curved and configured to wrap around the first curved 48, and another set bracket pieces 60 for the second curved corner 52. Thus, each bracket piece 60 of the wear plate material may have a different radius of curvature depending on the radius of curvature of the curved corner the piece is to wrap around. As shown in FIG. 6, wear strips 62 of the wear plate material are attached to the brackets 60 extend along the bottom surface of the bucket 12. Thus, from the wear plate 65, the attached bracket 60 extends around the first curved corner 48 to a wear strip 62 that extends across the bottom of the bucket 12 to another bracket 60 on the opposite side of the bucket 12.

INDUSTRIAL APPLICABILITY

In general, the teachings of the present disclosure may find applicability in many industries including, but not limited to, excavators. More specifically, the teachings of the present disclosure may find applicability in any industry using buckets, or shovels, in a digging operation, such as, but not limit to, mining, excavating, agriculture, construction, and the like.

Figure 11:
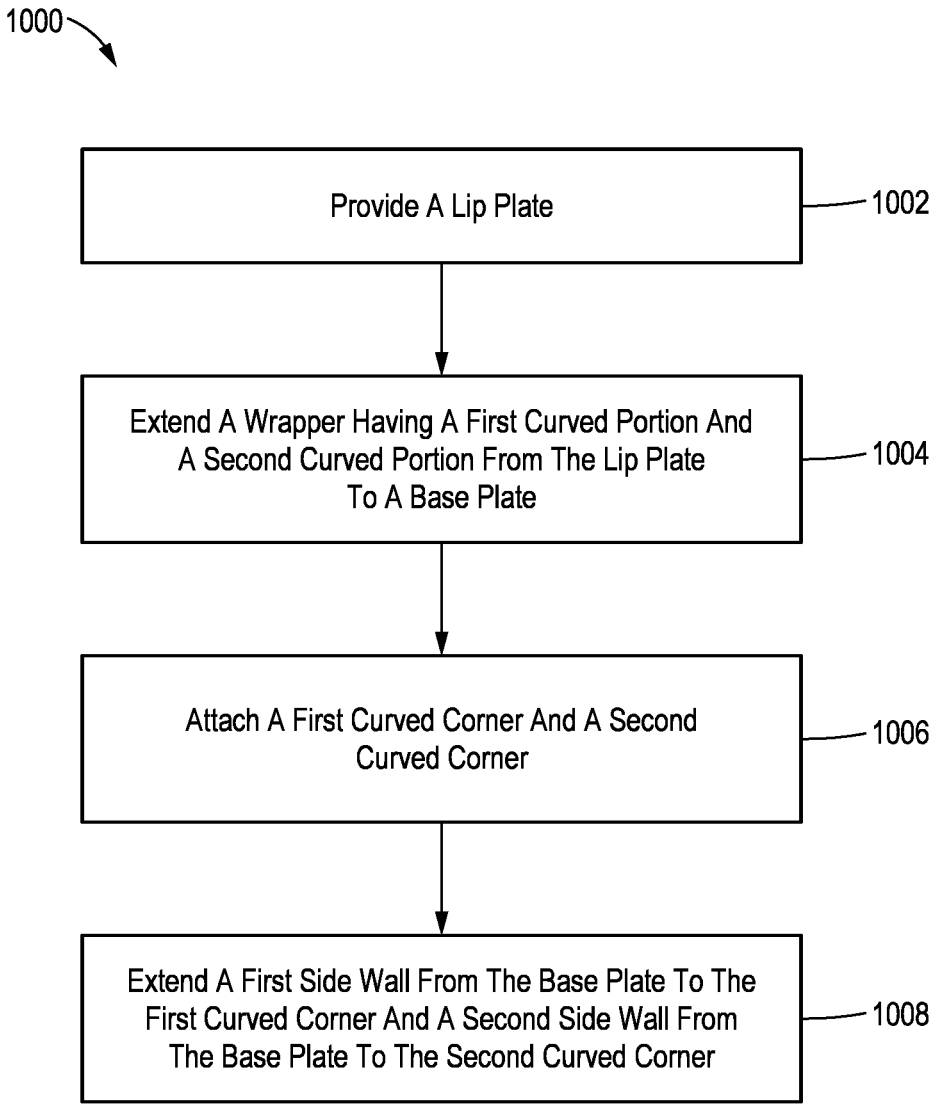
FIG. 11 is a flow chart of a series of steps that may be involved in the making of a bucket, in accordance with aspects of the present disclosure.

During digging or construction operations involving buckets, the belly plates of the bucket may scrape the ground and construction sites more often than the rest of the bucket causing uneven wear patterns on the sides of the belly plate on the bucket. FIG. 11, with continued reference to FIGS. 1-10 outlines a method of constructing a bucket that has a two radius wrapper with a downward angled cutting edge that reduces material resistance in concerned areas of the wrapper during a digging operation.

Starting with step 1002, a lip plate 31 that defines the bottom lip plane 37 of the bucket, and a base plate 23 that defines inner cavity ceiling 45 are provided. At step 1004 a wrapper 38 is extended from the bottom end 29 of the bucket 12 to the base plate 23. The wrapper 38 has a first curved portion 41 that has a first radius of curvature (A) that extends from the bottom end 29 of the bucket 12 to a first flat portion 40 of the wrapper 38, the first flat portion 40 extends from the first curved portion 41 to a second curved portion 39 of the wrapper 38 that has a second radius of curvature (B), and the second curved portion 39 extends from the first flat portion 40 to the base plate 23. At step 1006, the first curved corner 48 and the second curved corner 52 are attached to the bucket. Finally, at step 1008, a first side plate 19 is extended from the base plate 23 to the first curved corner 48 and a second side plate 20 is extended from the base plate 23 to a second curved corner 52.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

What is claimed is:

1. A bucket for a work machine, comprising:
- a lip plate at a bottom end of the bucket;
- a base plate at a top end of the bucket;
- a first side plate and a second side plate extending downwardly from the base plate to the bottom end of the bucket;
- a wrapper attached to the lip plate and the base plate, the wrapper comprising:
  - a first curved portion having a first radius of curvature at the bottom end of the bucket extending between a first flat portion and a second flat portion,
  - a second curved portion having a second radius of curvature extending from the first flat portion towards the base plate, and
  - the first flat portion connecting the first curved portion and the second curved portion is substantially planar;
  - the second flat portion connecting the first curved portion and the lip plate;
- a first curved corner and a second curved corner, the first curved corner extends from a first side of the wrapper to the first side plate, and the second curved corner extends from a second side of the wrapper to the second side plate; and
- one or more wear brackets extend from a first wear plate on the first side plate and a second wear plate on the second side plate, the one or more wear brackets configured to curve around the first curved corner and the second curved corner, respectively.

2. The bucket of claim 1, in which the first radius of curvature is smaller than the second radius of curvature.

3. The bucket of claim 1, in which a cutting edge of the bucket comprises the lip plate, a plurality of teeth attached to the lip plate extending away from the bucket.

4. The bucket of claim 3, in which the lip plate is angled between 1 and 5 degrees downwards relative to the second flat portion.

5. The bucket of claim 1, in which the first curved corner has a first corner arc surface defining a first corner arc, and the second curved corner has a second corner arc surface defining a second corner arc.

6. The bucket of claim 5, in which the first curved corner and the second curved corner extend along the second flat portion to the second curved portion.

7. The bucket of claim 6, in which the first curved corner and the second curved corner have a constant radius of curvature portion extending from the first curved portion through the first flat portion.

8. The bucket of claim 7, in which the first curved corner and the second curved corner have a first decreasing radius of curvature portion extending from the constant radius of curvature portion towards the lip plate.

9. The bucket of claim 8, in which the first curved corner and the second curved corner have a second decreasing radius of curvature portion extending from the constant radius of curvature portion towards the base plate.

10. The bucket of claim 9, in which the constant radius of curvature portion of the first curved corner and the second curved corner is comprised of or plated with a harder metal than the first decreasing radius of curvature portion and the second decreasing radius of curvature portion.

11. A method of making the bucket of claim 1, the method comprising:
- providing the base plate and the lip plate, the base plate configured to define an inner cavity ceiling of the bucket and the lip plate configured to define a lip plane at a bottom end of the bucket;
- extending the wrapper from the lip plate to the base plate;
- attaching the first curved corner to the first side of the wrapper and the second curved corner to the second side of the wrapper; and
- extending the first side plate from the base plate to the first curved corner and the second side plate from the base plate to the second curved corner.

12. The method of claim 11, in which the wrapper is concave shaped, the concave shape of the wrapper configured to allow the wrapper to align with the first curved corner and the second curved corner to form a bottom surface of the bucket.

13. The method of claim 11, in which the curved corners are configured to promote distributed wear across the bucket during a digging operation.

14. A work machine, comprising:
- a base configured to be supported on a ground surface;
- a revolving frame coupled to the base and rotatable about an axis;
- an arm coupled to the revolving frame; and
  - a bucket having a base plate at a top end of the bucket and a hinge assembly including a pair of hinge plates connected to the base plate at the top end of the bucket, the bucket pivotally coupled to the arm and supported via the hinge assembly, the bucket further comprising:
  - a first side plate and a second side plate extending downwards from the base plate to a bottom end of the bucket,
  - a lip plate at the bottom end,
  - a wrapper attached to the lip plate and the base plate,
  - the wrapper having a first flat portion, a second flat portion, and a first curved portion having a first radius of curvature at the bottom end of the bucket, the first curved portion connecting the first flat portion and the second flat portion, wherein the first curved portion has a first arcuate length along the wrapper, the first curved portion orienting the first flat portion and the second flat portion of the wrapper to extend at an obtuse, first angle relative to one another, the wrapper including a second curved portion having a second radius of curvature, the second curved portion connecting the first flat portion and the base plate, the first flat portion connecting the first curved portion and the second curved portion is substantially planar;

wherein the second curved portion has a second arcuate length along the wrapper that is larger than the first arcuate length of the first curved portion, the second curved portion orienting the first flat portion and the base plate to extend at a second angle relative to one another that is less than the first angle, wherein the first flat portion includes a first length extending between the first curved portion and the second curved portion, wherein the second flat portion includes a second length extending between the lip plate and the first curved portion, the second length being less than the first length, a first curved corner and a second curved corner, the first curved corner extends from a first side of the wrapper to the first side plate, and the second curved corner extends from a second side of the wrapper to the second side plate; and one or more wear brackets extend from a first wear plate on the first side plate and a second wear plate on the second side plate, the one or more wear brackets configured to curve around the first curved corner and the second curved corner, respectively.

15. The work machine of claim 14, in which the lip plate comprises a plurality of adaptors, each adaptor of the plurality of adaptors configured to hold a pierce digging tooth, the lip plate defines a lip plane, the lip plane pointing in a downward direction between 1 and 5 degrees and is configured to facilitate downward inclined edge cutting during a digging operation.

16. The work machine of claim 14, in which the wrapper is constructed of 2 or more pieces.

* * * * *